US008418518B2

(12) United States Patent
Chiu et al.

(10) Patent No.: US 8,418,518 B2
(45) Date of Patent: Apr. 16, 2013

(54) CONTACT BENDING FIXTURE

(75) Inventors: Kuo-chuan Chiu, Tu Cheng (TW); Feng-chi Lee, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 432 days.

(21) Appl. No.: 12/876,093

(22) Filed: Sep. 3, 2010

(65) Prior Publication Data

US 2012/0055221 A1 Mar. 8, 2012

(51) Int. Cl.
*B21D 5/00* (2006.01)

(52) U.S. Cl.
USPC ..... 72/380; 72/455; 72/470

(58) Field of Classification Search ..... 72/31.1, 72/31.11, 31.07, 312, 380, 386, 389.1, 455, 72/465.1, 466.8, 466.9, 470; 29/402.19, 29/825, 829, 835; 100/155 R, 156
See application file for complete search history.

(56) References Cited

U.S. PATENT DOCUMENTS 3,451,246 A * 6/1969 Shewan et al. ..... 72/466.9
5,970,766 A * 10/1999 Sosa-Razon et al. ..... 72/312
8,141,237 B1 * 3/2012 Wei et al. ..... 29/739

FOREIGN PATENT DOCUMENTS

JP 59174220 A * 10/1984

* cited by examiner

*Primary Examiner* — Teresa M Ekiert
(74) *Attorney, Agent, or Firm* — Cheng-Ju Chiang

(57) ABSTRACT

A contact bending fixture includes a lower die slider, a positioning rod, a linear actuating mechanism, and an upper die slider. A lower die mounted on the lower die slider includes a die holder, a lower bending module, a contact holding stick, and a bearing roller. The lower bending module includes a smooth sustaining side surface facing the bearing roller for defining an insertion gap therebetween. An upper die mounted on the upper die slider opposes the lower die and includes a punch holder, a hold-down plate, an elastic component, and an upper bending module. The hold-down plate presses and holds down an end of an under-bending contact on the top surface of lower bending module with an opposite end of the contact suspending in the insertion gap. Therefore, the contact bending fixture is capable of bending a contact at a required angle in one step.

5 Claims, 12 Drawing Sheets

CONTACT BENDING FIXTURE

BACKGROUND OF THE INVENTION

1. Field of the Invention

The present invention generally relates to a mechanical device, and particularly to a contact bending fixture.

2. Description of Prior Art

Connectors are common components in electronic engineering field. The connectors are provided for electrically connecting separated sub-circuits or isolated sub-circuits of a circuit so that current flows through the circuit to realize predetermined functions of the circuit. The connectors are indispensable components in electronic equipments. One or more connectors are found in the circuit if tracing along a conductive path of the circuit is made. There are a huge variety of different types of connectors available in the market. With the changes of application, frequency, power, application environment, and the likes, connectors involve different forms and structures. For example, connectors used in sports court lighting, connectors for hard disk drivers, and connectors for rocket control are very different from one another. No matter what kind of connector used, current should continuously and reliably flow through the circuit.

A connector typically includes an insulating housing, supporting members, and conductive contacts. The contacts are accommodated in the insulating housing. The supporting members support the insulating housing and secure the connector to a circuit board.

After being punched, the contacts are straight and not bent, so that they are not yet available for use in a connector. A bending operation is performed for bending the contacts at a predetermined angle before the contacts are used in a connector. However, during the bending operation of the contacts, residual stresses often cause the material of the contacts to spring back towards its original position, so that a two-step bending method is often employed to solve the problem of spring-back.

A conventionally used solution is illustrated in FIGS. 1 and 2, which involves a two-step bending operation. In a first step, a contact 3 is held between an upper die block 1 and a lower die block 2. A bending slider 4 presses the contact 3 to pre-form a shape. In a second step, the preformed contact 3' available in the first step is held between an upper die block 1' and a lower die block 2'. A bending slider 4' further presses the preformed contact 3' to a desired final shape.

However, in such a manufacturing process, bending method needs is carried out with two steps in order to reach the desired shape of the contact. This results in an extension of the manufacturing time, and an increase of manpower, and requirement for extra room. Therefore, the conventional method is adverse for improving manufacturing efficiency and reducing manufacturing costs.

SUMMARY OF THE INVENTION

To solve the above-mentioned problem, an objective of the present invention is to provide a contact bending fixture, which has a simple structure and is capable of bending a contact at a required angle through a simple bending operation that is carried out in a single step.

To achieve the above objective, the invention provides a contact bending fixture comprising a lower die slider, a positioning rod, a linear actuating mechanism, and an upper die slider. The lower die slider is horizontally positioned. The positioning rod has a lower end securely mounted to the lower die slider, and an upper end slidably extending through the upper die slider. The upper die slider is coupled to the linear actuating mechanism. The contact bending fixture further comprises a lower die mounted on the lower die slider. The lower die comprises a die holder, a lower bending module, a contact holding stick, and a bearing roller. The bearing roller is rotatably mounted on the die holder. The lower bending module is mounted on the die holder and comprises a smooth sustaining side surface facing the bearing roller for defining an insertion gap therebetween. The contact holding stick is mounted on a top surface of the lower bending module. The contact bending fixture further comprises an upper die mounted on the upper die slider and opposes the lower die. The upper die comprises a punch holder, a hold-down plate, an elastic component, and an upper bending module. The punch holder is of a hollow structure and defines an opening in a side face thereof facing the bearing roller. The upper bending module is rotatably received in the opening and opposes the insertion gap of the lower die. The elastic component has an end secured to the punch holder and another end securely connected to the hold-down plate. The hold-down plate is positioned right above the top surface of the lower bending module. The hold-down plate defines a receiving hole corresponding to the contact holding stick. The hold-down plate presses and holds down an end of an under-bending contact on the top surface of lower bending module. An opposite end of the under-bending contact suspends in the insertion gap of the lower die. The linear actuating mechanism drives the upper bending module into the insertion gap of the lower die to thereby bend the contact.

As stated previously, the hold-down plate presses and holds down an end of an under-bending contact on the top surface of the lower bending module. An opposite end of the under-bending contact suspends in the insertion gap of the lower die. The linear actuating mechanism drives the upper bending module into the insertion gap of the lower die to thereby bend the contact. The lower bending module is mounted on the die holder and comprises a smooth sustaining side surface. Therefore, the contact bending fixture of the present invention is capable of bending a contact at a greater angle in a bending operation, thereby preventing spring back of a bending-completed contact. Therefore, the contact bending fixture is capable of bending a contact at a required angle in one step.

BRIEF DESCRIPTION OF THE DRAWINGS

The present invention may best be understood through the following description with reference to the accompanying drawings, wherein.

DETAILED DESCRIPTION OF THE PREFERRED EMBODIMENT

Figure 1:
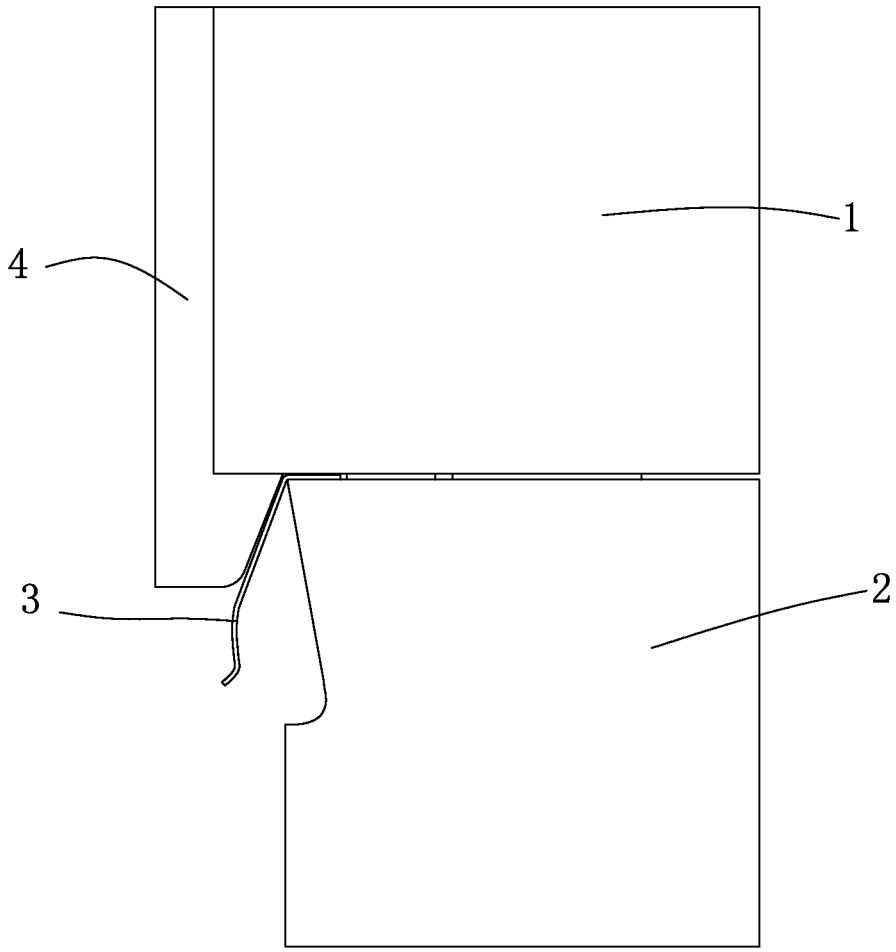
FIG. 1 (PRIOR ART)
FIG. 1 illustrates a first bending step of a conventional two-step bending fixture.
Figure 2:
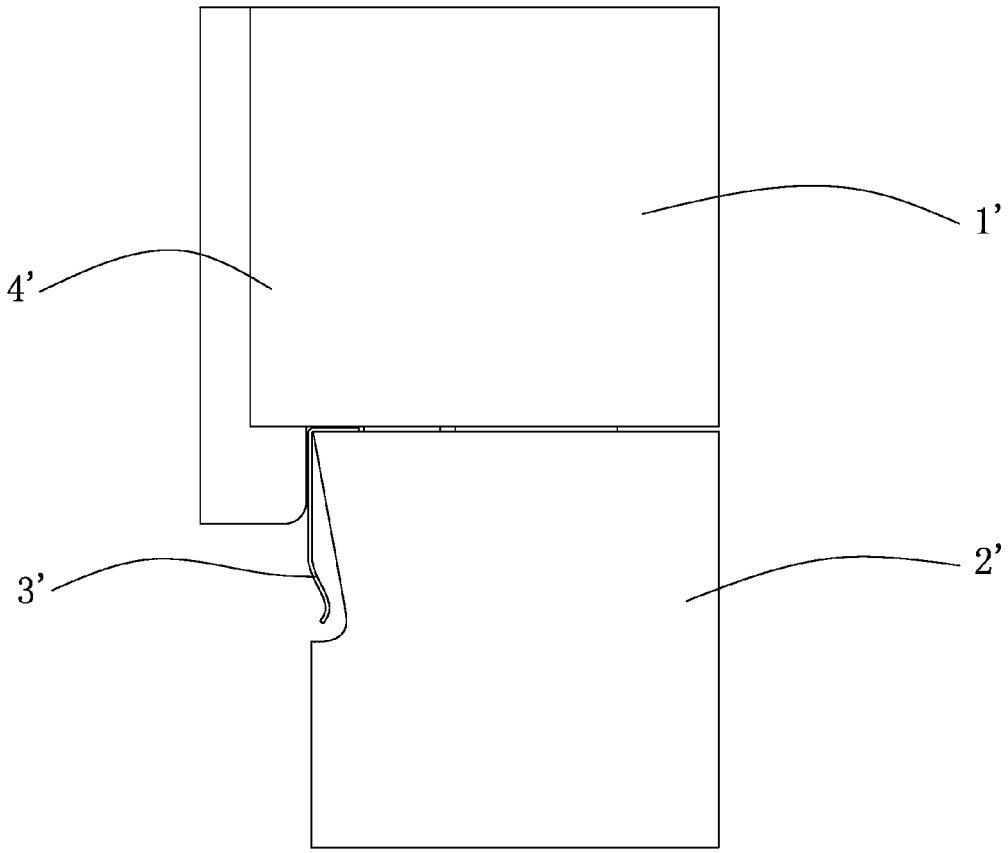
FIG. 2 (PRIOR ART)
FIG. 2 illustrates a second bending step of the conventional two-step bending fixture.
Figure 3:
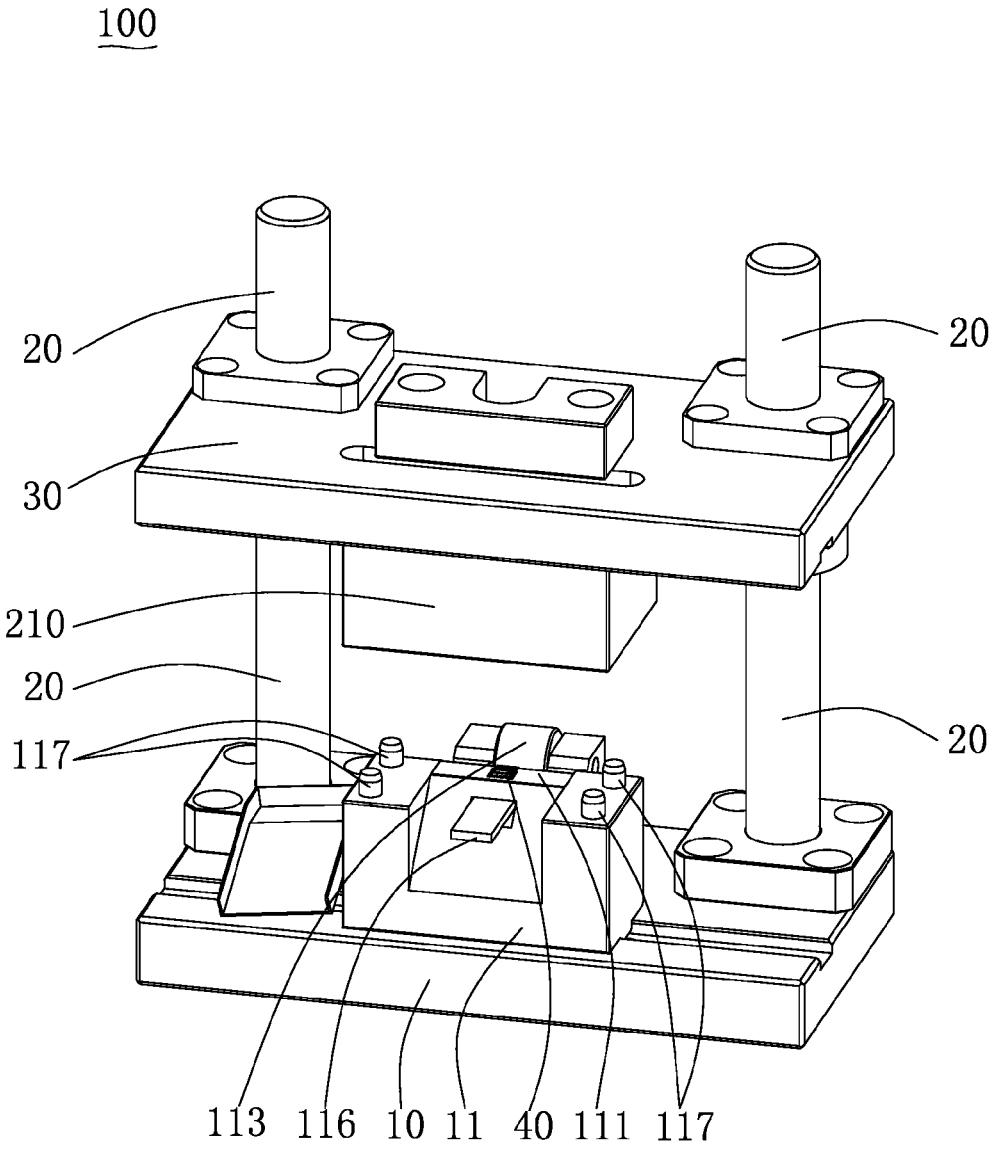
FIG. 3 is a perspective view illustrating a contact bending fixture according to the present invention.
Figure 4:
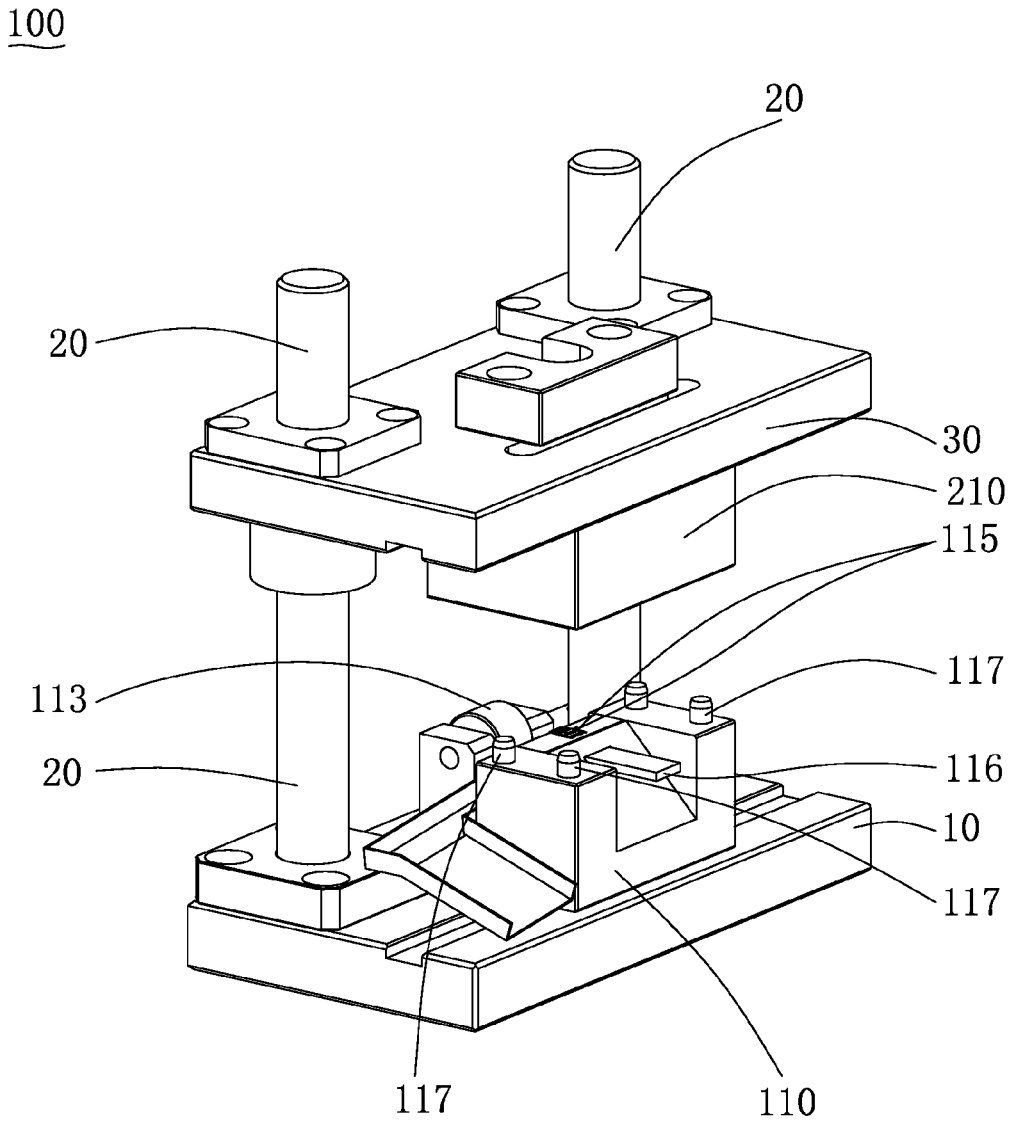
FIG. 4 is another perspective view of the contact bending fixture of the present invention.

Referring to FIGS. 3 and 4, a contact bending fixture 100 according to the present invention comprises a lower die slider 10, positioning rods 20, a linear actuating mechanism (not shown), and an upper die slider 30. The lower die slider 10 is horizontally positioned. The positioning rods 20 have lower ends securely mounted to the lower die slider 10 and upper ends slidably extending through the upper die slider 30. The upper die slider 30 is coupled to the linear actuating mechanism.

Figure 5:
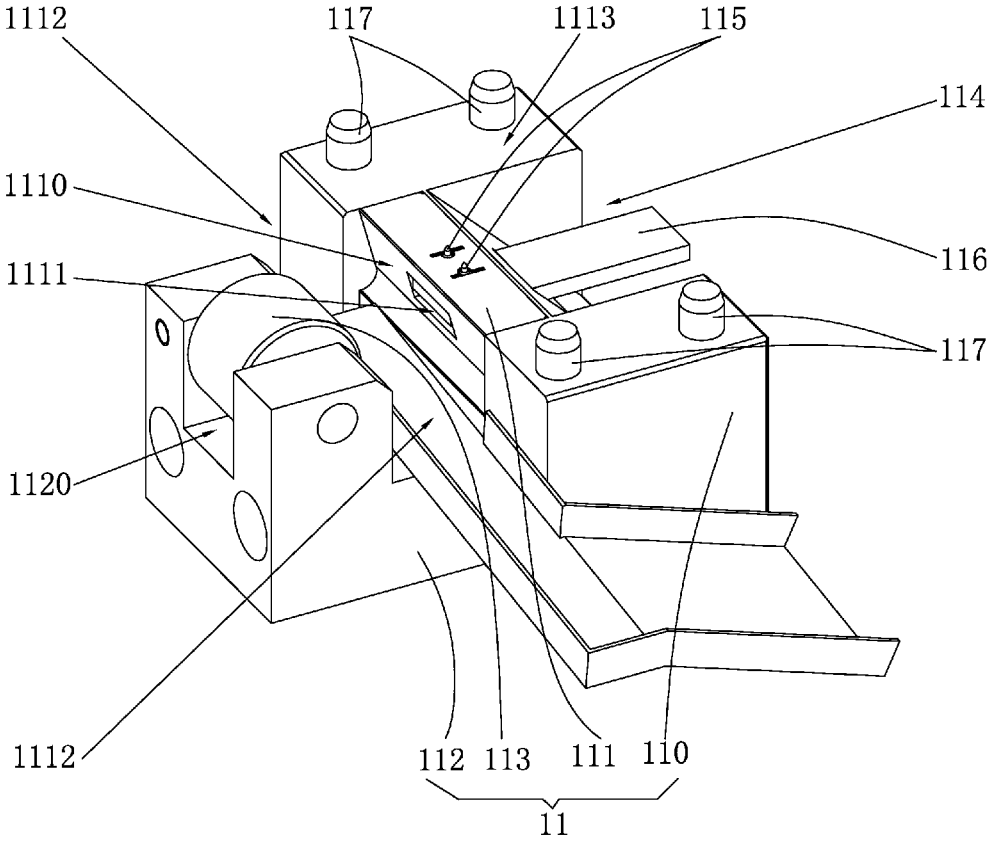
FIG. 5 is a perspective view illustrating a lower die of the contact bending fixture according to the present invention.
Figure 6:
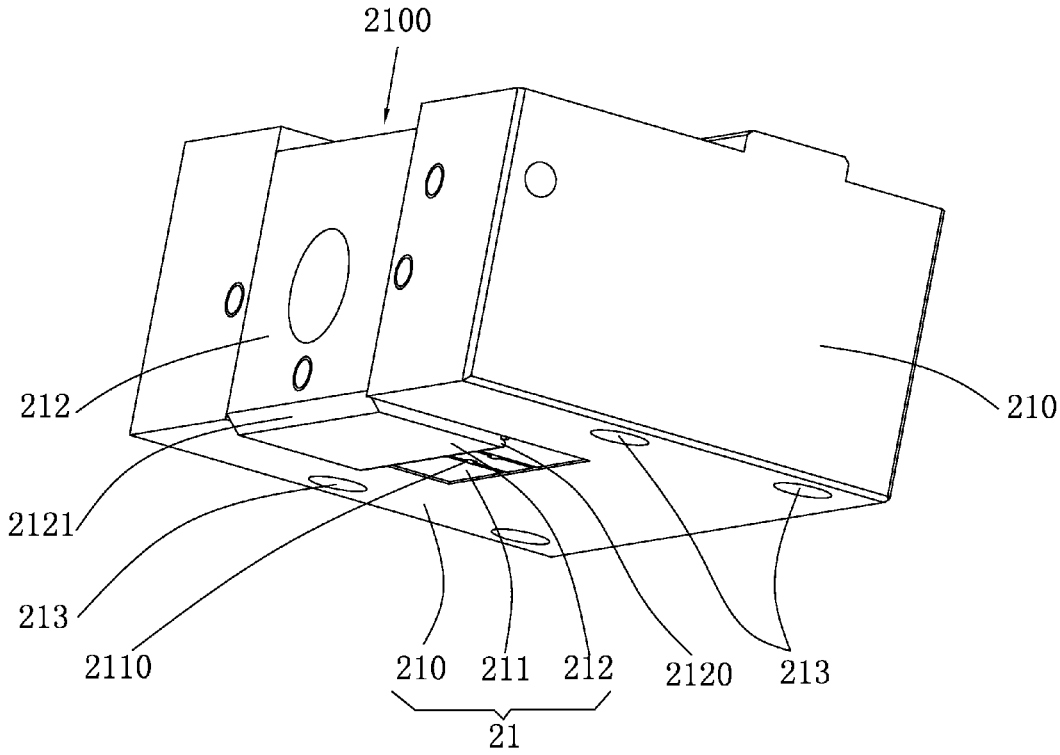
FIG. 6 is a perspective view illustrating an upper die of the contact bending fixture according to the present invention.

Referring to FIGS. 5 and 6, a lower die 11 is mounted on the lower die slider 10. The lower die 11 comprises a die holder 110, a lower bending module 111, contact holding sticks 115, and a bearing roller 113. The bearing roller 113 is rotatably mounted to the die holder 110. The lower bending module 111 is mounted on the die holder 110 and comprises a smooth sustaining side surface 1110 facing the bearing roller 113 for defining an insertion gap 1112 therebetween. The contact holding sticks 115 are mounted on a top surface 1113 of the lower bending module 111.

Figure 7:
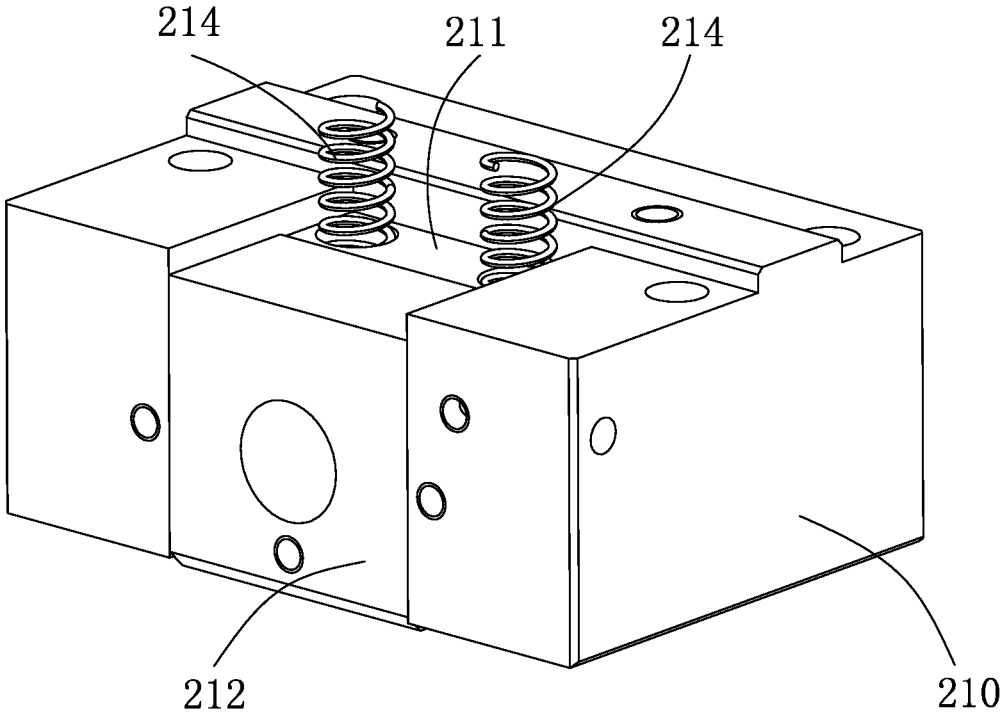
FIG. 7 is another perspective view of the upper die of the contact bending fixture according to the present invention.

Referring to FIGS. 6 and 7, an upper die 21 is mounted on the upper die slider 30 and opposes the lower die 11. The upper die 21 comprises a punch holder 210, a hold-down plate 211, elastic components 214, and an upper bending module 212. The punch holder 210 is of a hollow structure and defines an opening 2100 in a side face thereof facing the bearing roller 113. The upper bending module 212 is rotatably received in the opening 2100 and opposes the insertion gap 1112 of the lower die 11. Each of the elastic components 214 has an end secured to the punch holder 210 and another end securely connected to the hold-down plate 211. The hold-down plate 211 is positioned right above the top surface 1113 of the lower bending module 111. The hold-down plate 211 defines receiving holes 2110 corresponding to the contact holding sticks 115, respectively. The hold-down plate 211 presses and holds down an end of an under-bending contact 40 on the top surface 1113 of the lower bending module 111. An opposite end of the under-bending contact 40 suspends in the insertion gap 1112 of the lower die 11. The linear actuating mechanism drives the upper bending module 212 into the insertion gap 1112 of the lower die 11 to thereby bend the contact 40.

Referring to FIG. 5, the die holder 110 comprises a bearing holder 112 protruding therefrom, and the bearing roller 113 is rotatably supported on the bearing holder 112.

Referring to FIGS. 6 and 7, a bottom surface of the upper bending module 212 comprises a side recessed to form an inclined structure 2121 and another side forming a circular arc-shaped structure 2120. The inclined structure 2121 has a side engageable with the bearing roller 113.

Referring to FIGS. 4 and 5, the contact bending fixture 100 of the present invention further comprises an ejection plate 116. The die holder 110 defines an opening 1111. The contact holding sticks 115 have bottom ends extending into the opening 1111 to engage the ejection plate 116 and top ends extending beyond the top surface 1113 of the lower bending module 111.

Referring to FIGS. 4 and 6, the die holder 110 comprises locating pins 117. The punch holder 210 forms locating holes 213 for engaging the locating pins 117.

Figure 8:
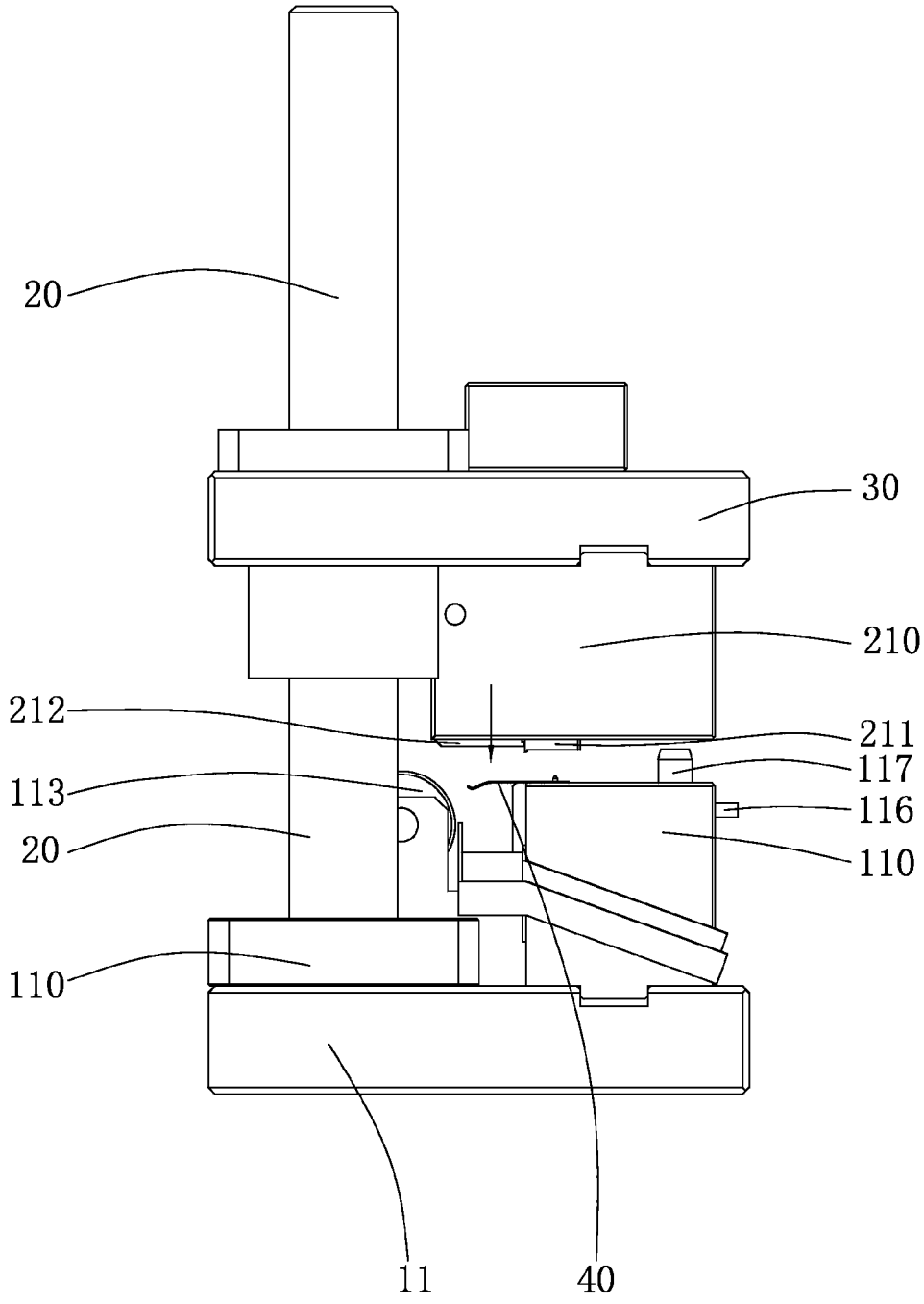
FIG. 8 is a side elevational illustrating the contact bending fixture ready for bending a contact.
Figure 9:
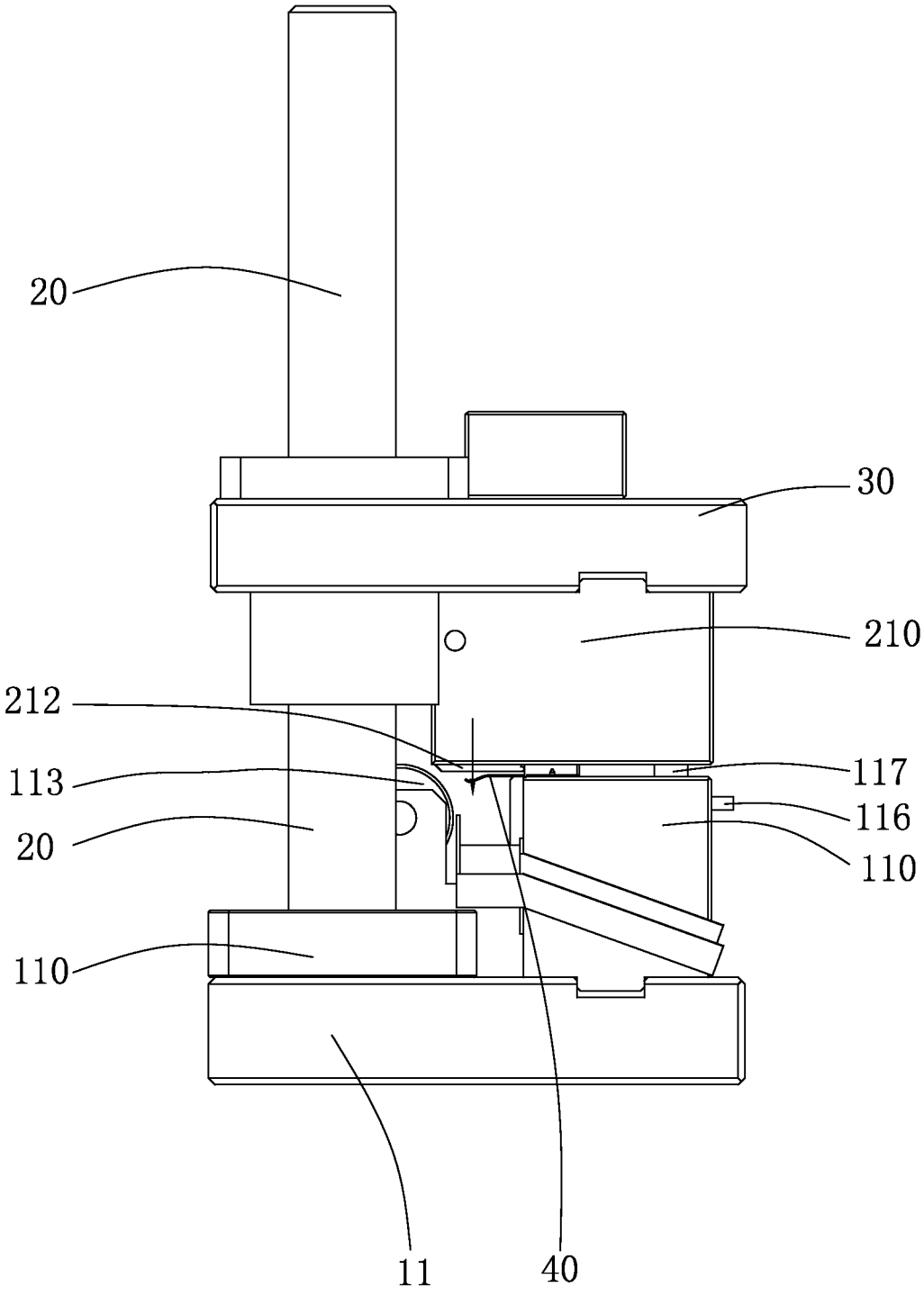
FIG. 9 is a side elevational illustrating the contact bending fixture pre-bending the contact.
Figure 10:
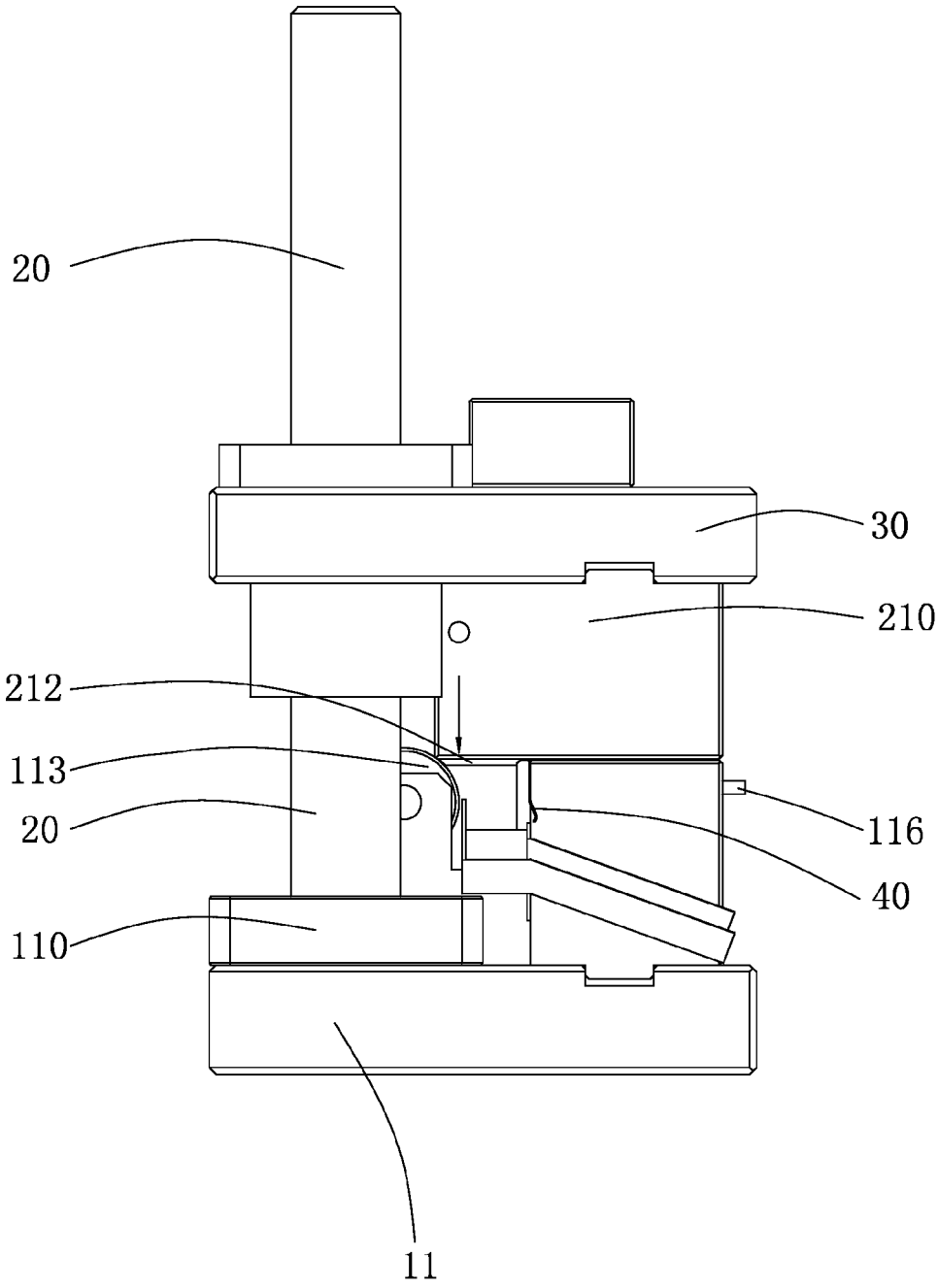
FIG. 10 is a side elevational view illustrating the contact bending fixture completing the bending of the contact.
Figure 11:
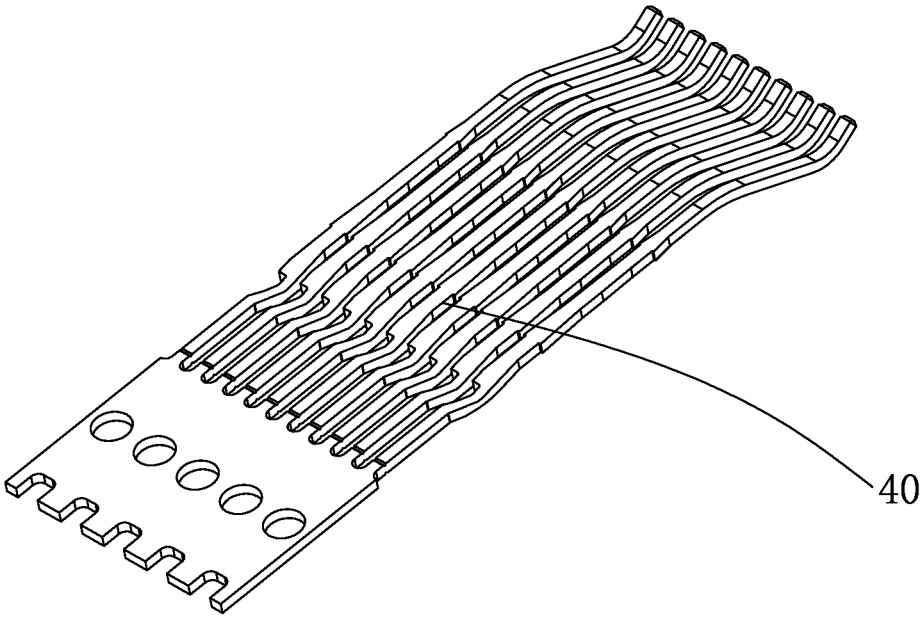
FIG. 11 is a perspective view showing contacts before being bent by the contact bending fixture of the present invention.
Figure 12:
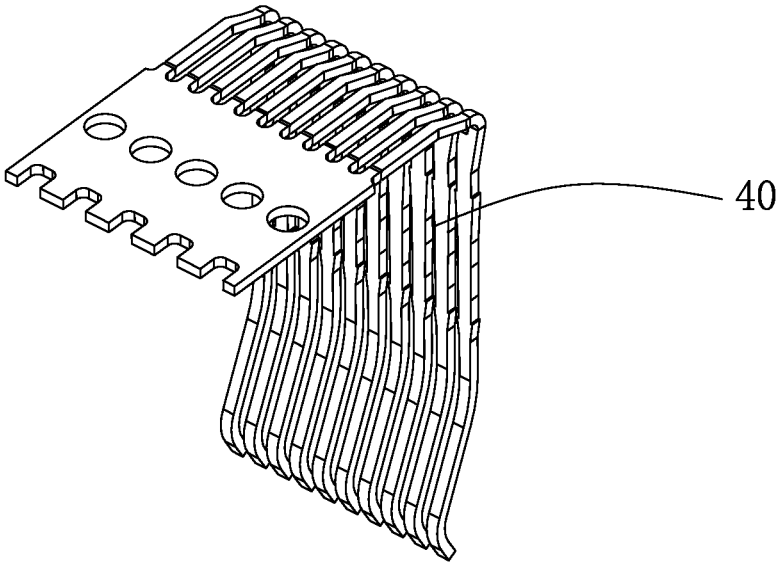
FIG. 12 is a perspective view showing contacts after being bent by the contact bending fixture of the present invention.

Referring to FIGS. 8, 9 and 10, in an initial condition, the upper die 21 is separated from the lower die 11. The contacts 40 are positioned on the die holder 110, and more precisely on the contact holding sticks 115. The upper die slider 30 slides downwardly and drives the upper die 21 downwardly. As a result, the locating pins 117 formed on the die holder 110 respectively engage the locating holes 213 of the punch holder 210. Next, the hold-down plate 211 presses and holds down the contacts 40. The receiving holes 2110 of the hold-down plate 211 are provided for positioning the contacts 40, thereby preventing undesired displacement of the contacts 40. Then, the upper bending module 212 downwardly presses the contacts 40 for pre-bending the contacts 40. With continuous downward pressing of the upper die 21, the hold-down plate 211 is forced to contract inward to get substantially flush with the punch holder 210 but still holds down the contacts 40. Because the insertion gap 1112 is defined between the sustaining side surface 1110 and the bearing roller 113, with continuous downward pressing of the upper bending module 212, when the inclined structure 2121 contacts the bearing roller 113 mounted on the bearing holder 112, the upper bending module 212 is forced to inwardly slant and continues to move downwardly. The circular arc-shaped structure 2120 of the upper bending module 212 further inwardly bends the contacts 40 at a final angle greater than an angle reached in the first bending of the contacts 40, thereby finally finishing bending of the contacts 40 and preventing spring back of final bent contacts 40. Finally, the upper die 21 and the hold-down plate 211 are moved upwardly and the contact 40 of which bending is completed is taken out. FIGS. 11 and 12 respectively show under-bending contacts 40 and bending-completed contacts 40, and clearly, the bending-completed contacts 40 have a very different structure from the under-bending contacts 40.

As stated previously, the contact bending fixture of the present invention is capable of bending contacts at a greater angle in a bending operation, thereby preventing spring back of the bending-completed contacts. Therefore, the contact bending fixture is capable of bending contacts at a required angle in one step.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact bending fixture, comprising a lower die slider, positioning rods, a linear actuating mechanism, and an upper die slider, the lower die slider being horizontally positioned, the positioning rods having lower ends securely mounted to the lower die slider and upper ends slidably extending through the upper die slider, the upper die slider being coupled to the linear actuating mechanism, the contact bending fixture further comprising:

a lower die mounted on the lower die slider, the lower die comprising a die holder, a lower bending module, a contact holding stick, and a bearing roller, the bearing roller being rotatably mounted on the die holder, the lower bending module being mounted on the die holder and comprising a smooth sustaining side surface facing the bearing roller, thereby defining an insertion gap between the sustaining side surface and the bearing roller, the contact holding stick being mounted on a top surface of the lower bending module;

an upper die mounted on the upper die slider and opposing the lower die, the upper die comprising a punch holder, a hold-down plate, an elastic component, and an upper bending module, the punch holder being of a hollow structure and defining an opening in a side face thereof facing the bearing roller, the upper bending module being rotatably received in the opening and opposing the insertion gap, the elastic component having an end secured to the punch holder and another end securely connected to the hold-down plate, the hold-down plate being positioned right above the top surface of lower bending module, the hold-down plate defining a receiving hole corresponding to the contact holding stick, the hold-down plate pressing and holding down an end of an under-bending contact on the top surface of lower bending module, an opposite end of the under-bending contact suspending in the insertion gap, the linear actuating mechanism driving the upper bending module into the insertion gap to thereby bend the contact.

2. The contact bending fixture of claim 1, wherein the die holder comprises a bearing holder protruding therefrom, and the bearing roller is rotatably supported on the bearing holder.

3. The contact bending fixture of claim 1, wherein a bottom surface of the upper bending module comprises a side recessed to form an inclined structure, and another side forming a circular arc-shaped structure, the inclined structure having a side engageable with the bearing roller.

4. The contact bending fixture of claim 1 further comprising an ejection plate, the die holder defining an opening, the contact holding stick having a bottom end extending into the opening to engage the ejection plate and a top end extending beyond the top surface of the lower bending module.

5. The contact bending fixture of claim 1, wherein the die holder comprises a locating pins, the punch holder defining a locating hole for engaging the locating pin.

* * * * *